US007640770B2

(12) United States Patent
Miyai

(10) Patent No.: US 7,640,770 B2
(45) Date of Patent: Jan. 5, 2010

(54) FABRIC KNITTING METHOD AND KNITTED PRODUCT

(75) Inventor: Takuya Miyai, Wakayama (JP)

(73) Assignee: Shima Seiki Manufacturing Limited, Wakayama-shi (JP)

( * ) Notice: Subject to any disclaimer, the term of this patent is extended or adjusted under 35 U.S.C. 154(b) by 207 days.

(21) Appl. No.: 11/921,032

(22) PCT Filed: May 25, 2006

(86) PCT No.: PCT/JP2006/310491

§ 371 (c)(1),
(2), (4) Date: Nov. 26, 2007

(87) PCT Pub. No.: WO2006/126650

PCT Pub. Date: Nov. 30, 2006

(65) Prior Publication Data

US 2009/0100878 A1 Apr. 23, 2009

(30) Foreign Application Priority Data

May 26, 2005 (JP) ..... 2005-154353

(51) Int. Cl.
*D04B 1/10* (2006.01)

(52) U.S. Cl. ..... 66/169 R

(58) Field of Classification Search ..... 66/64, 66/60 R, 196–200, 75.1
See application file for complete search history.

(56) References Cited

U.S. PATENT DOCUMENTS 2,295,793 A * 9/1942 Kaufman ..... 66/169 R (Continued)

FOREIGN PATENT DOCUMENTS

EP 0 955 4 01 11/1999

(Continued)

OTHER PUBLICATIONS

PCT/ISA/210.

(Continued)

*Primary Examiner*—Danny Worrell
(74) *Attorney, Agent, or Firm*—Harness, Dickey & Pierce, P.L.C.

(57) ABSTRACT

In one embodiment of the present application, a knitting method is disclosed for a knitting fabric capable of eliminating the need of stitch transfer during knitting and easily knitting even a thick and less stretchable knitting fabric. Three types of stitching including knits marked with "O," tacks marked with "V," and missings marked with "-" are knitted repeatedly in a course direction and a wale direction. The thickness of the clothing fabric of a knitted product is 1.5 times that by plain knitting or thicker which is equal to a thickness obtained by rib knitting. The elongation of the knitted product in the course direction is approximately 1.5 times that by the other methods which is approximately half an elongation obtained by plain knitting which is approximately three times that by the other methods. The elongation of the knitted product in the wale direction is approximately 1.7 to 1.8 times that obtained by the other methods which is equal to an elongation obtained by plain knitting. Since the three types of stitches including the knits, tacks, and missings may be repeatedly knitted in each course for knitting the knitting fabric, the stitch transfer is not required during the knitting, and the thick and laterally less stretchable knitting fabric can be easily knitted.

13 Claims, 3 Drawing Sheets

11

U.S. PATENT DOCUMENTS

| | | | | |
|---|---|---|---|---|
| 3,986,374 | A * | 10/1976 | Fane | 66/190 |
| 5,174,134 | A | 12/1992 | Okuno | |
| 6,125,661 | A | 10/2000 | Shima | |

FOREIGN PATENT DOCUMENTS

| | | |
|---|---|---|
| JP | 48-12779 | 4/1973 |
| JP | 12779/1973 | 4/1973 |
| JP | 06-220750 | 8/1994 |
| JP | 07-37699 | 2/1995 |
| JP | 11-302952 | 11/1999 |
| JP | 2000-027053 | 1/2000 |
| JP | 2004-124291 | 4/2004 |

OTHER PUBLICATIONS

International Preliminary Report on Patentability (Chapter II) for International Application No. PCT/JP2006/310491 dated Mar. 27, 2008.

* cited by examiner

FIG. 5

| SAMPLE | KNITTING ORDER | STRUCTURE | COMPARISON WITH PLAIN STITCH | FABRIC THICKNESS | HORIZONTAL STRETCH | VERTICAL STRETCH |
|---|---|---|---|---|---|---|
| KNITTED FABRIC 1 | ↑ | V – O V – O<br>O V – O V –<br>– O V – O V<br>V – O V – O<br>O V – O V – OR V O – V O –<br>O – V O – V<br>– V O – V O<br>V O – V O –<br>O – V O – V | - APPROX. 5 TO 10% WIDER IN HORIZONTAL DIRECTION, AND APPROX. 20 TO 30% SHORTER IN VERTICAL DIRECTION<br>- GOOD LOOP STABILITY | 1.8 | APPROX. 1.5 TIMES | 1.7 TO 1.8 TIMES |
| KNITTED FABRIC 11 | ↑ | – O V – O V<br>O V – O V –<br>V – O V – O<br>– O V – O V<br>O V – O V – OR – V O – V O<br>O – V O – V<br>V O – V O –<br>– V O – V O<br>O – V O – V | - APPROX. 5 TO 10% WIDER IN HORIZONTAL DIRECTION, AND SHORTER IN VERTICAL DIRECTION<br>- GOOD LOOP STABILITY | 1.5 | APPROX. 1.5 TIMES | 1.7 TO 1.8 TIMES |
| KNIT + MISS | ↑ | – O – – O –<br>O – – O – –<br>– – O – – O<br>– O – – O –<br>O – – O – – OR – – O – – O<br>– O – –<br>– – O – –<br>O – – O – –<br>O – – O – – | - APPROX. 5 TO 10% NARROWER IN HORIZONTAL DIRECTION, AND LONGER IN VERTICAL DIRECTION<br>- POOR LOOP STABILITY | 1.5 | APPROX. 1.5 TIMES | APPROX. 2.3 TIMES |
| PLAIN STITCH | ↑ | O O O O O O<br>O O O O O O<br>O O O O O O | | 1 | APPROX. 3 TIMES | 1.7 TO 1.8 TIMES |

FABRIC KNITTING METHOD AND KNITTED PRODUCT

TECHNICAL FIELD

The present invention relates to a fabric knitting method for knitting a fabric in weft knitting so as to be thick, and a knitted product.

BACKGROUND ART

Conventionally, in weft knitting, a basic knitted fabric is knitted in plain knitting in which knitting is performed to form knit stitches. Plain knitting is also referred to as plain stitch. For example, a flat-type flat knitting machine is provided with needle beds that are opposed to each other, and using knitting needles of the mutually opposed needle beds, a knitted fabric in so-called rib knitting or rib stitch can be knitted. Using rib knitting, a knitted fabric can be knitted that is thicker than in plain knitting, in a structure in interlock, milano rib, or the like. In rib knitting, basically, knitting is performed alternately using knitting needles of mutually opposed needle beds for each stitch in the course direction, and a groove and a streak in the wale direction are alternately formed. Interlock provides a structure in which two basic rib knitted fabrics are relatively shifted in the course direction and thus a groove line on one fabric is filled with a streak line on the other fabric, so that the surface becomes smooth. Interlock is also referred to as smooth, double rib, or the like. In milano rib, a knitted fabric for two-course knitting is knitted in which continuously after a course of basic rib knitting, a course of plain knitting is knitted on each of the mutually opposed needle beds.

Even in a plain knitted structure, a thick knitted fabric can be knitted, for example, in moss stitch knitting in which knit and tuck are combined. The applicant has disclosed a thick, less stretched or contracted, and firm knitted fabric knitted by combining plain knitting and transfer knitting (see Japanese Examined Patent Publication JP-B2 7-37699 (1995), for example).

Basically, sewing is not necessary when a knitted product that is to be worn on the human body is knitted, for example, as a tubular knitted fabric having a shape corresponding to wearing portions such as the upper body, the lower body, the arms and the legs. A tubular knitted fabric can be knitted even in a flat-type flat knitting machine, by performing plain knitting on each of mutually opposed needle beds. However, there is a limitation on knitting a structure in rib knitting in order to make at least a part of the knitted fabric thick. An ordinary flat-type flat knitting machine has two front and back needle beds that are opposed to each other, and thus in order to knit a tubular knitted fabric including a rib knitted structure, for example, drawn-off knitting is performed in which odd-numbered knitting needles and even-numbered knitting needles on each needle bed are respectively allocated to the front side and the back side of the tubular knitted fabric. In drawn-off knitting, a knitted fabric feels coarser than the actual gauge number.

As a flat knitting machine, a machine with a larger number of needle beds also has been realized, and examples thereof include a four-bed machine with four needle beds in total in which two beds are provided in each of the front and back portions. With such a flat knitting machine, a tubular knitted fabric including a rib knitted structure can be easily knitted. However, a four-bed machine has a complicated mechanical structure, and thus such a machine is limited.

A structure in moss stitch knitting is inferior in thickness to a rib knitted structure. However, for a rib knitted structure, transferring is necessary in the course of knitting both in the case of performing drawn-off knitting and in the case of using a four-bed machine. Thus, a rib knitted structure requires a complicated knitting process and takes effort. The knitted fabric in JP-B2 7-37699 has a similar problem because transferring is necessary.

DISCLOSURE OF INVENTION

An object of the invention is to provide a fabric knitting method for knitting a knitted fabric that does not require transferring in the course of knitting and that enables a thick and less stretchable knitted fabric to be easily knitted, and a knitted product.

The invention provides a fabric knitting method for knitting a fabric in weft knitting so as to be thick, comprising the steps of:

repeatedly forming a line of stitches in which three types of stitches of knit, tuck and miss are arranged one by one in a predetermined first order in a course direction; and repeatedly forming a line of stitches in which three types of stitches of knit, tuck and miss are arranged one by one in a predetermined second order in a wale direction, thereby knitting a fabric in which one stitch is constituted by a combination of a loop of knit, a loop of tuck and a crossing yarn of miss.

Furthermore, in the invention, it is preferable that the second order is knit, tuck, and then miss.

Furthermore, in the invention it is preferable that the second order is knit, miss, and then tuck.

Furthermore, in the invention it is preferable that apart of a weft-knitted fabric is knitted by repeatedly knitting the three types of stitches.

Moreover, the invention provides a knitted product knitted by the fabric knitting method according to any one of the above methods.

BRIEF DESCRIPTION OF DRAWINGS

Other and further objects, features, and advantages of the invention will be more explicit from the following detailed description taken with reference to the drawings wherein:

FIG. 5 is a chart showing the knitted fabrics 1 and 11 knitted in the embodiments of FIGS. 1 and 3, in comparison with another knitted fabric knitted using another fabric knitting method.

BEST MODE FOR CARRYING OUT THE INVENTION

Figure 1:
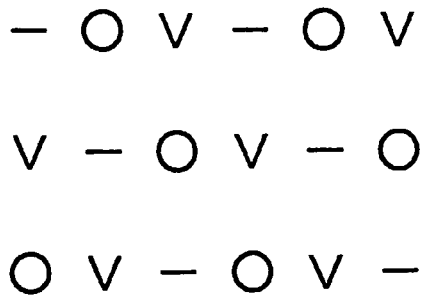
FIG. 1 is a view showing a needle selecting state of knitting needles in the case of performing a fabric knitting method for knitting a fabric according to an embodiment of the invention.

Now referring to the drawings, preferred embodiments of the invention are described below.

FIG. 1 shows an example of a needle selecting state of knitting needles in the case of performing a fabric knitting method for knitting a fabric according to an embodiment of the invention. In FIG. 1, the horizontal direction is the course direction, and the vertical direction is the wale direction. With respect to the wale direction, courses are subsequently knitted from below to above in FIG. 1. A symbol "O" indicates a knitting needle selected for knit, a symbol "V" indicates a knitting needle selected for tuck, and a symbol "-" indicates a knitting needle selected for miss. In the first course, three types of needle selections are repeated in the order of "O", "V", and then "-" to the right in FIG. 1. A knitting needle for "O" in the first course is for "V" in the second course, and for "-" in the third course. Thus, the order in which three types of knitted stitches are repeated is the same in the course direction and the wale direction. It should be noted that in the course direction and in the wale direction, the same needle selection is not performed in adjacent portions, and needle selections performed therein are made different from each other without fail. The invention is preferably used in a flat knitting machine for knitting a knitted fabric. A flat knitting machine includes a pair of front and back needle beds, a plurality of knitting needles, and carriages. The pair of front and back needle beds are arranged, for example, in the shape of an inverted V such that the tip ends face each other. The plurality of needle beds are arranged side by side in the longitudinal direction on each needle bed. The carriage is provided so as to travel back and forth in the longitudinal direction on each needle bed.

Figure 2:
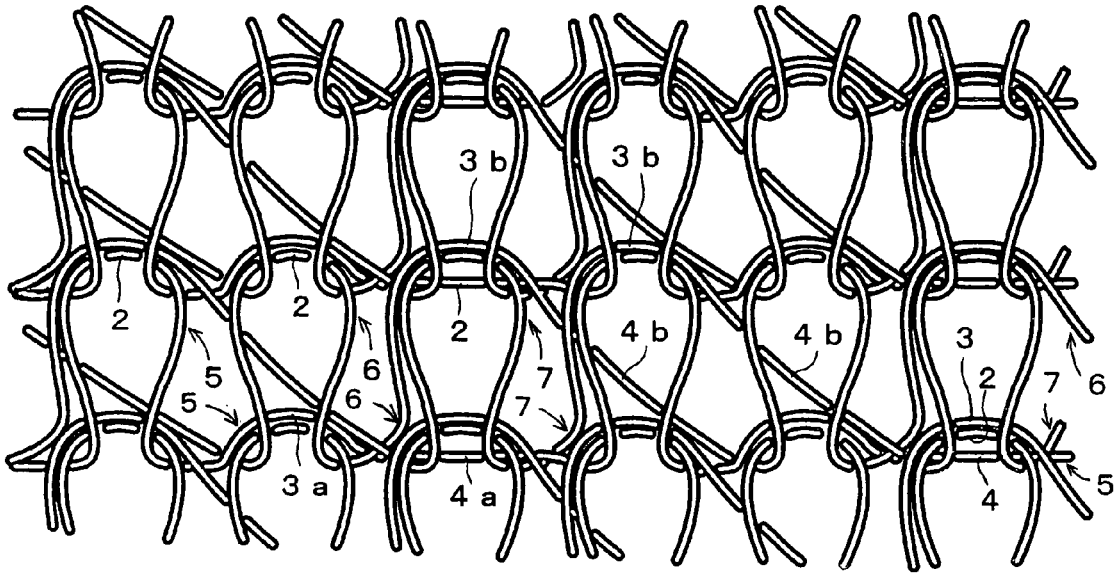
FIG. 2 is a view schematically showing the structure of a knitted fabric 1 that is knitted in the needle selecting state of knitting needles as in FIG. 1.

FIG. 2 schematically shows the structure of a knitted fabric 1 that is knitted in the needle selecting state of knitting needles as in FIG. 1. One stitch in the knitted fabric 1 is constituted by a combination of a loop of knit 2, a loop of tuck 3, and a crossing yarn of miss 4. A stitch line for one course of the knitted fabric 1 is formed in three courses of knitting in total using three knitting yarns 5, 6, and 7.

Also with the knitting yarns 5, 6, and 7, a loop of knit 2, a loop of tuck 3, and a crossing yarn of miss 4 are repeatedly formed. It should be noted that each of a loop of tuck 3, and a crossing yarn of miss 4 has two different shapes. More specifically, tuck 3 includes tuck 3*a* and tuck 3*b* that are formed at different positions in the wale direction. Miss 4 includes miss 4*a* and miss 4*b* whose crossing yarns are different from each other in shape. With the knitting yarn 5, a loop of knit 2, a loop of tuck 3*a*, and a crossing yarn of miss 4*a* are repeatedly formed. With each of the knitting yarns 6 and 7, a loop of knit 2, a loop of tuck 3*b*, and a crossing yarn of miss 4*b* are repeatedly formed. Herein, a needle loop of tuck 3*a* is formed on the side of a sinker loop of knit 2 that is adjacent to this needle loop in the same course, while a needle loop of tuck 3*b* is formed on the side of a needle loop of knit 2 that is adjacent to this needle loop in the same course. Furthermore, a crossing yarn of miss 4*a* is formed continuously after a sinker loop of tuck 3*a* and continue to a sinker loop of knit 2 that is adjacent to this crossing yarn in the same course, while a crossing yarn of miss 4*b* is obliquely formed between a sinker loop of tuck 3*b* and a sinker loop of knit 2.

Figures 3, 4:
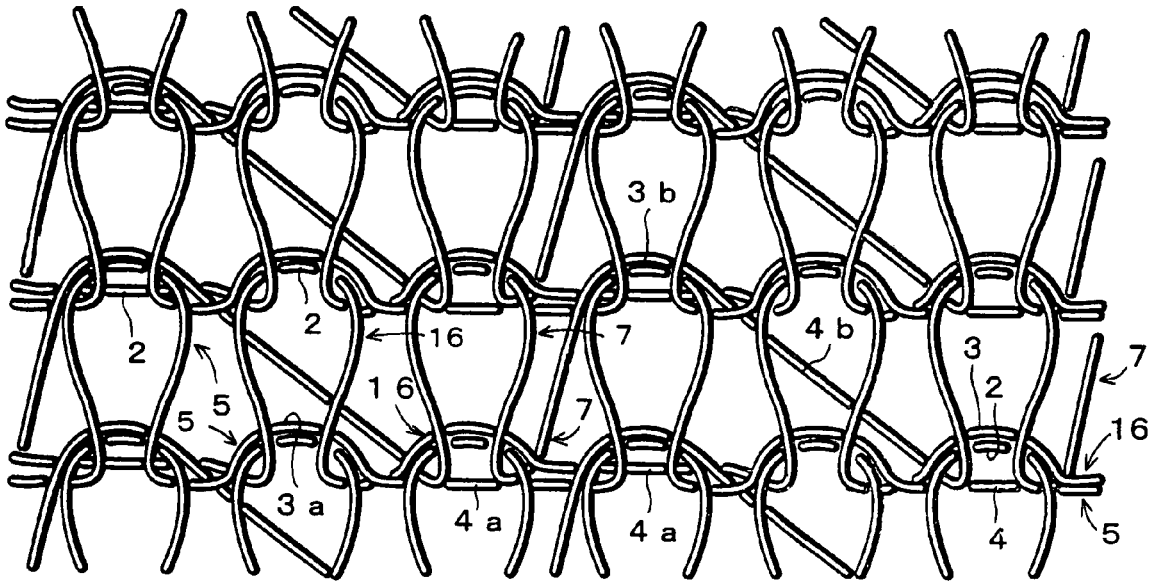
FIG. 3 is a view showing a needle selecting state of knitting needles in the case of performing a fabric knitting method for knitting a fabric according to another embodiment of the invention.
FIG. 4 is a view schematically showing the structure of a knitted fabric 11 that is knitted in the needle selecting state of knitting needles as in FIG. 2.

FIG. 3 shows, as in FIG. 1, an example of a needle selecting state of knitting needles in the case of performing a fabric knitting method for knitting a fabric as another embodiment of the invention. In the first course, "O", "V", and "-" are arranged in this order to the right in FIG. 3, but FIG. 3 is different from FIG. 1 in that a knitting needle for "O" in the first course is for "-" in the second course, and for "V" in the third course; that is, the order in which three types of knitted stitches are repeated is different between the course direction and the wale direction.

FIG. 4 schematically shows the structure of a knitted fabric 11 that is knitted in the needle selecting state of knitting needles as in FIG. 2. One stitch in the knitted fabric 11 is constituted by a combination of a loop of knit 2, a loop of tuck 3, and a crossing yarn of miss 4. Of these, for example, combinations of loops and crossing yarns that are formed with the knitting yarns 5 and 7 are similar to those in FIG. 2. However, a knitting yarn 16 corresponding to the knitting yarn 6 in FIG. 2 forms a combination of loops and a crossing yarn similar to that with the knitting yarn 5. Thus, in the knitted fabric 11 that is formed with the three knitting yarns 5, 7, and 16, two tucks 3*a* and misses 4*a*, and one tuck 3*b* and miss 4*b* are formed in each course.

FIG. 5 shows the knitted fabrics 1 and 11 knitted in the embodiments of FIGS. 1 and 3, in comparison with another knitted fabric knitted using another fabric knitting method. As a comparison example, a knitted fabric is shown in which knit and miss are combined. In this knitted fabric, the needle selection is performed such that two misses are formed with respect to one knit, and the knitted fabric for one course is knitted in three courses of knitting as in the knitted fabrics 1 and 11 in the embodiments, and thus a knitted fabric can be knitted that does not require transferring and that is thick. However, since there are many loops with misses, the stability of the loops is poor. Plain stitch refers to a basic structure in which all stitches are knitted as knits, and is used as a reference with respect to thickness of the fabrics. The comparative knitted fabric is knitted using the same knitting yarns in a flat knitting machine having the same gauge.

In the embodiments of FIGS. 1 and 3, while three types of stitches of knit 2, tuck 3, and miss 4 are repeatedly knitted in a predetermined first order in the course direction, the three types of stitches of knit 2, tuck 3, and miss 4 are repeatedly knitted in a predetermined second order in the wale direction. In each stitch for one course of the knitted fabrics 1 and 11 that are knitted, loops of knit 2 and tuck 3, and a crossing yarn of miss 4 are formed, and thus the knitted fabrics 1 and 11 can be knitted that are thick and firm. The fabrics are at least 1.5 times as thick as the plain stitched fabric, and can be as thick as a rib knitted fabric. In the horizontal direction, which is the course direction, the fabrics are stretchable to approximately 1.5 times, and are approximately half as stretchable as the plain stitched fabric that is stretchable to approximately 3 times. In the vertical direction, which is the wale direction, the fabrics are stretchable to approximately 1.7 to 1.8 times, and are as stretchable as the plain stitched fabric. Each course for knitting the knitted fabrics 1 and 11 can be knitted by repeatedly knitting the three types of stitches of knit 2, tuck 3, and miss 4, so that transferring is not necessary in the course of knitting, and the knitted fabrics 1 and 11 can be easily knitted that are thick and less stretchable in the horizontal direction.

In the embodiment of FIG. 1, as shown in FIG. 2, knit 2, tuck 3, and miss 4 are repeatedly formed in this order in each stitch line in the wale direction. As shown in FIG. 5, the thickness of the fabric is 1.8; that is, the thickness of the knitted fabric 1 can be easily increased. In the embodiment of FIG. 3, as shown in FIG. 4, knit 2, miss 4, and tuck 3 are repeatedly formed in this order in each stitch line in the wale direction. As shown in FIG. 5, the degree to which the knitted fabric 11 is shorter than the plain stitched fabric in the vertical direction (wale direction) can be smaller than that in the embodiment of FIG. 1. The thickness of the fabric is 1.5, that is, slightly smaller than 1.8 in the embodiment of FIG. 1.

A comparison between FIGS. 2 and 4 shows the following. In each formed stitch, knock-over is performed with both of a loop of knit 2 and a loop of tuck 3*a*, 3*b*. Thus, the fabrics become thicker, and wider in the horizontal direction, than the plain stitched fabric. In FIG. 2, the number of obliquely arranged crossing yarns of misses 4*b* is larger than that in FIG. 4. Thus, in FIG. 2, the fabric pulls itself in the vertical direction, and thus the fabric is shorter in the vertical direction and thicker than the fabric in FIG. 4.

The knitted fabrics 1 and 11 according to the embodiments of FIGS. 1 and 3 may be formed as apart of a knitwear or the like, and sewn to be a knitted product such as a knitwear. Also, in a flat knitting machine having front and back needle beds, round-knitting may be performed to form the knitted fabrics 1 and 11 as a tubular knitted fabric, thereby forming a knitted product such as a knitwear without sewing. The knitted fabrics can be obtained that are, even without transferring, as thick as a rib structure at the same gauge, that have suppressed stretch properties in the course direction in spite of being a knitted item, and that are stable. Thus, the knitted fabrics can be preferably applied to a knitted product such as gloves at a fine gauge. The knitted fabrics can be preferably applied also to a product that is to be coated in the following process. A highly strong yarn such as an aramid fiber may be knitted into, for example, safety-conscious gloves with cutting resistance. It is difficult to knit a rib knitted structure using such a highly strong yarn. However, according to the embodiments, using such a highly strong yarn, it is possible to knit a knitted fabric that is thick and less stretchable.

Furthermore, the knitted fabrics 1 and 11 may be formed by repeatedly knitting knit 2, tuck 3, and miss 4 on a part of a knitted fabric in weft knitting. Thus, the knitted fabric can be made partially thick, for example, for reinforcement. In a knitwear such as a sweater, a suit, or a skirt, a portion that does not have to be stretchable such as a lapel, a fly, a waist portion, or a belt portion can be made thick.

The knitted fabrics 1 and 11 described above are thick and can be contracted to some extent, and thus favorable supporting properties for protecting a wearing portion of the body can be obtained. Accordingly, the knitted fabrics can be applied to socks, gloves, and supporters for the elbows, the knees, and the like. The knitted fabrics 1 and 11 are characterized by having a thick touch to some extent, and being stretched and contracted as appropriate. Moreover, the knitted fabrics 1 and 11 are stable, and are less likely to be wrinkled.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

INDUSTRIAL APPLICABILITY

According to the invention, a thick and firm knitted fabric can be knitted by knitting a thick knitted fabric in weft knitting by repeatedly forming a line of stitches in which three types of stitches of knit, tuck, and miss are used one by one, in each of the course direction and the wale direction. Each course for knitting the knitted fabric can be knitted by repeatedly knitting the three types of stitches of knit, tuck and miss, so that transferring is not necessary in the course of knitting, and the thick and less stretchable knitted fabric can be easily knitted.

Furthermore, according to the invention, the thickness of the knitted fabric can be easily increased.

Furthermore, according to the invention, the degree to which the knitted fabric is shortened in the wale direction can be reduced.

Furthermore, according to the invention, by repeatedly forming a line of stitches in which three types of stitches of knit, tuck, and miss are used one by one on a part of the knitted fabric in weft knitting, the knitted fabric can be made partially thick, for example, for reinforcement.

Furthermore, according to the invention, a whole or part of a knitted product knitted in weft knitting can be thick. For example, gloves, socks, and the like can be made thick in whole, or in a knitwear such as a sweater, a portion that does not have to be stretchable such as a lapel, a fly, or a waist portion can be made thick.

The invention claimed is:

1. A fabric knitting method for knitting a fabric in weft knitting so as to be thick, comprising the steps of:

repeatedly forming a line of stitches in which three types of stitches of knit, tuck, and miss are arranged one by one in a predetermined first order in a course direction; and repeatedly forming a line of stitches in which three types of stitches of knit, tuck and miss are arranged one by one in a predetermined second order in a wale direction, thereby knitting a fabric in which one stitch is constituted by a combination of a loop of knit, a loop of tuck and a crossing yarn of miss.

2. The fabric knitting method of claim 1, wherein the second order is knit, tuck, and then miss.

3. The fabric knitting method of claim 1, wherein the second order is knit, miss, and then tuck.

4. The fabric knitting method of claim 1, wherein a part of a weft-knitting fabric is knitted by repeatedly knitting the three types of stitches.

5. A knitted product knitted by the fabric knitting method according to the fabric knitting method of claim 1.

6. The fabric knitting method of claim 2, wherein a part of a weft-knitting fabric is knitted by repeatedly knitting the three types of stitches.

7. The fabric knitting method of claim 3, wherein a part of a weft-knitting fabric is knitted by repeatedly knitting the three types of stitches.

8. A knitted product knitted by the fabric knitting method according to the fabric knitting method of claim 2.

9. A knitted product knitted by the fabric knitting method according to the fabric knitting method of claim 3.

10. A knitted product knitted by the fabric knitting method according to the fabric knitting method of claim 4.

11. A knitted product knitted. by the fabric knitting method according to the fabric knitting method of claim 6.

12. A knitted product knitted by the fabric knitting method according to the fabric knitting method of claim 7.

13. A knitted product knitted by the fabric knitting method according to the fabric knitting method of claim 8.

* * * * *